United States Patent [19]

Ishikawa

[11] Patent Number: 4,875,422

[45] Date of Patent: Oct. 24, 1989

[54] REDUCED HEIGHT SEWING MACHINE WITH A ARCUATELY SWINGING NEEDLE BAR ARM

[75] Inventor: Hitoshi Ishikawa, Nishio, Japan

[73] Assignee: Aisin Seiki Kabushiki Kaisha, Aichi, Japan

[21] Appl. No.: 191,005

[22] Filed: May 6, 1988

[30] Foreign Application Priority Data

May 15, 1987 [JP] Japan ..... 62-119879
May 16, 1987 [JP] Japan ..... 62-119267

[51] Int. Cl.[4] ..... D05B 3/02; D05B 1/00

[52] U.S. Cl. ..... 112/258; 112/221; 112/228; 112/245

[58] Field of Search ..... 112/258, 259, 260, 228, 112/221, 245, 199, 98, 103, 162

[56] References Cited

U.S. PATENT DOCUMENTS

| | | | |
|---|---|---|---|
| 2,495,069 | 1/1950 | McCann | 112/159 X |
| 3,688,711 | 9/1972 | Szostaik et al. | 112/221 |
| 4,372,234 | 2/1983 | Killinger et al. | 112/258 |
| 4,463,695 | 8/1984 | Killinger | 112/199 |

FOREIGN PATENT DOCUMENTS 44-30179 12/1969 Japan .

*Primary Examiner*—Andrew M. Falik
*Attorney, Agent, or Firm*—Oblon, Spivak, McClelland, Maier & Neustadt

[57] ABSTRACT

A sewing machine has a bed housing having a needle penetrating hole at one end thereof, an arm housing rising from the other end of the bed housing and extending to the one end of the bed housing over the bed housing, a laterally-long needle bar arm rotatably held in the arm housing and having a needle at the front end thereof, and a drive unit for swinging the needle bar arm with respect to the bed housing accommodated in the bed housing. The arrangement of the laterally-long needle bar arm and the drive unit accommodated in the bed housing, can effectively reduce the overall height of the sewing machine. It further reduces the weight and cost of the sewing machine, since no conventional material, such as cast iron having a heavy weight is used and die cast aluminum associating with a higher cost, may be employed for producing the arm housing.

8 Claims, 11 Drawing Sheets

REDUCED HEIGHT SEWING MACHINE WITH A ARCUATELY SWINGING NEEDLE BAR ARM

BACKGROUND OF THE INVENTION

1. Field of the Invention

The present invention relates to a sewing machine having a height reduced as much as possible. The present invention can be applied to a small domestic sewing machine.

2. Discussion of the Related Art

It has been required to reduce the size of sewing machines, especially of domestic sewing machines. An example of the small-sized sewing machines is disclosed in Japanese Examined Patent Publication (KOKOKU) No. 30179/1969. The sewing machine comprises a bed housing, an arm housing rising from one end of the bed housing and extending to the other end of the bed housing over the bed housing, a link mechanism built-in in the arm housing, a vertically extending longitudinally-long needle bar held at the end of the link mechanism and having a needle, and a drive unit for actuating the link mechanism. The drive unit includes a drive motor and a main shaft disposed between the drive motor and the link mechanism.

The drive unit is actuated after the upper thread is run through the needle. The link mechanism swings, and the longitudinally-long needle bar reciprocates in the vertical direction. Thus, the needle held at the end of the needle bar penetrates a cloth, and stitches are formed.

As described above, the needle bar having the needle at the end has a longitudinally-long shape, and reciprocates in the vertical direction. Considering the reciprocating movement of the needle bar in the vertical direction, even if the size of the arm housing may be reduced, the top end of the needle bar goes through a hole of the arm housing and inevitably protrudes from the top surface of the arm housing, since it reciprocates in the vertical direction. Thus, there has been a limitation on the reduction of the sewing machine height. In addition, though the sewing machine disclosed in Japanese Examined Patent Publication (KOKOKU) No. 30179/1969 has a drive motor disposed in the bed housing, the main shaft is so vertically disposed that it penetrates the boundary between the bed housing and the arm housing and protrudes by half of its length. Thus, there has been another limitation on the reduction of the sewing machine height.

SUMMARY OF THE INVENTION

The present invention is developed in view of the drawbacks of the conventional sewing machine. And it is an object of the present invention to provide a sewing machine having an effectively reduced height.

The sewing machine of the present invention is different from the conventional sewing machine in that: the needle bar arm does not reciprocate linearly in the vertical direction but reciprocates and swings on an arc path, and the drive unit for swinging the needle bar arm is accomodated in the ged housing.

The sewing machine of the present invention comprises a bed housing having a needle penetrating hole at one end thereof, an arm housing rising from the other end of the bed housing and extending to the one end of the bed housing over the bed housing, a needle bar arm rotatably held in the arm housing and having a needle at the front end thereof, and a drive unit for swinging the needle bar arm with respect to the bed housing accomodated in the bed housing.

The bed housing and the arm housing work together as a unitary housing. The bed housing has a needle penetrating hole at one end thereof. It is preferred that the bed housing has a reduced height. The arm housing rises from the other end of the bed housing and extends to the one end of the bed housing over the bed housing.

In order to hold the needle bar arm rotatably, it is preferred to dispose a swing shaft horizontally in the bed housing and hold the needle bar arm rotatably with the swing shaft. It is preferred that the axis of the swing shaft and the top surface of a throat plate having the needle penetrating hole and held on the bed housing are flush with each other. This arrangement is advantageous in order to penetrate the needle perpendicular to a cloth held over the top surface of the throat plate, since the centripetal direction of the swinging needle, the top surface of the throat plate and the axis of the swing shaft substantially align. It is preferred to dispose the swing shaft; i.e. the center of the swinging needle bar arm, away from the needle held at the front end of the needle bar arm. The needle bar arm preferably comprises a riser held rotatably to the swing shaft and having a shorter height, and a laterally-long arm integral with the riser. This arrangement is advantageous for enlarging the distance between the needle and the swing shaft by the length of the laterally-long arm and for enlarging the radius of curvature when the needle swings, since the needle is held to the front end of the laterally-long arm. This arrangement is also advantageous for further reducing the height of the arm housing since the riser has a shorter height. In addition, when using a curved needle, the needle can penetrate the cloth in a perpendicular manner without disposing the axis of the swing shaft and top surface of the throat plate flush with each other.

The drive unit is accomodated in the bed housing and it swings the needle bar arm with respect to the bed housing. The drive unit includes a drive motor held in the bed housing, a main shaft held in a substantially horizontal direction as well as in a substantially parallel manner with the swing shaft held in the bed housing and run by the drive motor, and a converter for converting the rotation of the main shaft into the swing of the needle bar arm held in the bed housing and disposed between the needle bar arm and the main shaft. As the converter, a cam mechanism and a slider crank mechanism may be employed.

The bed housing further accomodates a rotary hook shaft disposed in a substantially parallel manner with the substantially horizontal main shaft, a rotary hook run by the rotary hook shaft and a transmission unit disposed between the rotary hook shaft and the main shaft. It is preferred to dispose the rotary hook shaft in a parallel manner with the substantially horizontal main shaft in order to reduce the height of the bed housing. The transmission unit may include a first timing gear installed to the main shaft, a second timing gear installed to the rotary hook shaft and a timing belt installed to the first and second timing gears. This arrangement is advantageous for improving the synchronism between the needle bar arm for operating the upper thread and the rotation of the rotary hook.

Further, the bed housing usually accomodates a thread take-up lever disposed adjacent the needle bar arm. The thread take-up lever is run by the main shaft.

The thread take-up lever may include a rising arm joined to the main shaft, having a shorter height anhd swinging with the rotation of the main shaft, and a laterally-long arm rotatably held to the rising arm, moving substantially horizontally and having a hook at the front end thereof. It is preferred to employ the following arrangement in order to run the laterally-long arm horizontally: guiding engagement portions formed in both sides of the hook, and a substantially horizontal guide hole formed in the arm housing and engaging the guiding engagement portions. Thus, the laterally-long arm having the hook reciprocates horizontally, and this arrangement is also advantageous for reducing the height of the housing.

The sewing machine of the present invention thus constructed is operated as follows: After the upper thread is run through the needle and a cloth is set below the needle, the drive unit is actuated. Then the needle bar arm swings, and the needle held at the end of the needle bar arm reciprocates and swings on an arc path, not linearly in the vertical direction. And then the needle penetrates the cloth, and stitches are formed.

The sewing machine of the present invention is appropriate for a small domestic sewing machine. When compared with the conventional sewing machine employing the longitudinally-long needle bar reciprocating in the vertical direction, the arrangement of the sewing machine of the present invention can reduce the overall height of the sewing machine, since the sewing machine of the present invention employs the laterally-long needle bar arm swinging with respect to the bed housing.

Further, the sewing machine of the present invention employs the needle bar arm comprising the laterally-long arm having a laterally-long length and the riser having a shorter height. Accordingly, the height of the sewing machine can be reduced and the distance between the swing center and the needle can be enlarged. In other words, this arrangement is advantageous for having the needle penetrated perpendicular to the cloth, since this arrangement reduces the height of the arm housing and enlarges the radius of curvature of the needle swinging with respect to the cloth.

Moreover, the sewing machine of the present invention is advantageous for further reducing the overall height of the sewing machine, since the drive unit for swinging the needle bar arm has been disposed in the bed housing. Thus, in view of this arrangement, the sewing machine of the present invention distinguishes over the sewing machine disclosed in Japanese Examined Patent Publication (KOKOKU) No. 30179/1969 employing the main shaft included in the drive unit, extending in the vertical direction and protruding from the bed housing to the arm housing.

BRIEF DESCRIPTION OF THE DRAWINGS

Drawings illustrate a sewing machine of a preferred embodiment of the present invention in which.

DETAILED DESCRIPTION OF THE PREFERRED EMBODIMENT

A sewing machine of a preferred embodiment according to this invention will be hereinafter described with reference to the accompanying drawings.

Arrangement of the Sewing Machine

Figure 1:
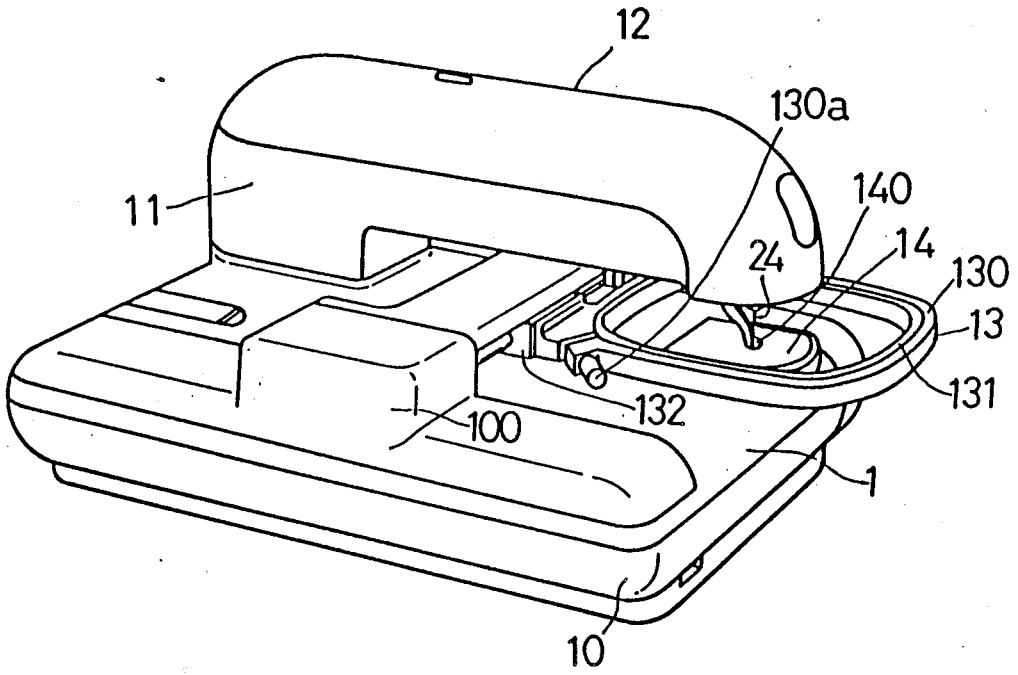
FIG. 1 is an overall perspective view of the sewing machine.

A housing 1 will be described with reference to FIG. 1. As shown in FIG. 1, the housing 1 comprises a bed housing 10 forming the lower part of the sewing machine and having a reduced height, and an arm housing 11 rising upward from one end of the bed housing and extending laterally over the bed housing 10. A throat plate 14 having a needle penetrating hole 140 is placed under the end of the arm housing 11, and installed to an end of the upper surface of the bed housing 10. A top cover 12 is detachably installed to the top opening of the arm housing 11. An embroidery frame 13 is installed to the bed housing 10. The embroidery frame 13 comprises an outer frame 130 and an inner frame 131. A cloth to be embroidered is held between the outer frame 130 and the inner frame 131 by operating the knob **130*a*. The embroidery frame 13 is installed to a shifter 132 and is moved by a motor unit 10 in the housing 1 in the X-axis and Y-axis directions. The motor unit 100 comprises built-in X-axis and Y-axis motors including stepping motors. The X-axis and Y-axis motors are controlled and driven by a control unit built-in in the housing 1 and including a CPU as a main component. The embroidery frame 13 is appropriately positioned in the X-axis and Y-axis directions. Programs for embroidery are stored in the storage element of the control unit. Thus, the X-axis and Y-axis motors are driven and the embroidery frame 13 is moved in accordance with the programs. The Y-axis motor is designated at 16 in FIG. 3**.

Figure 4:
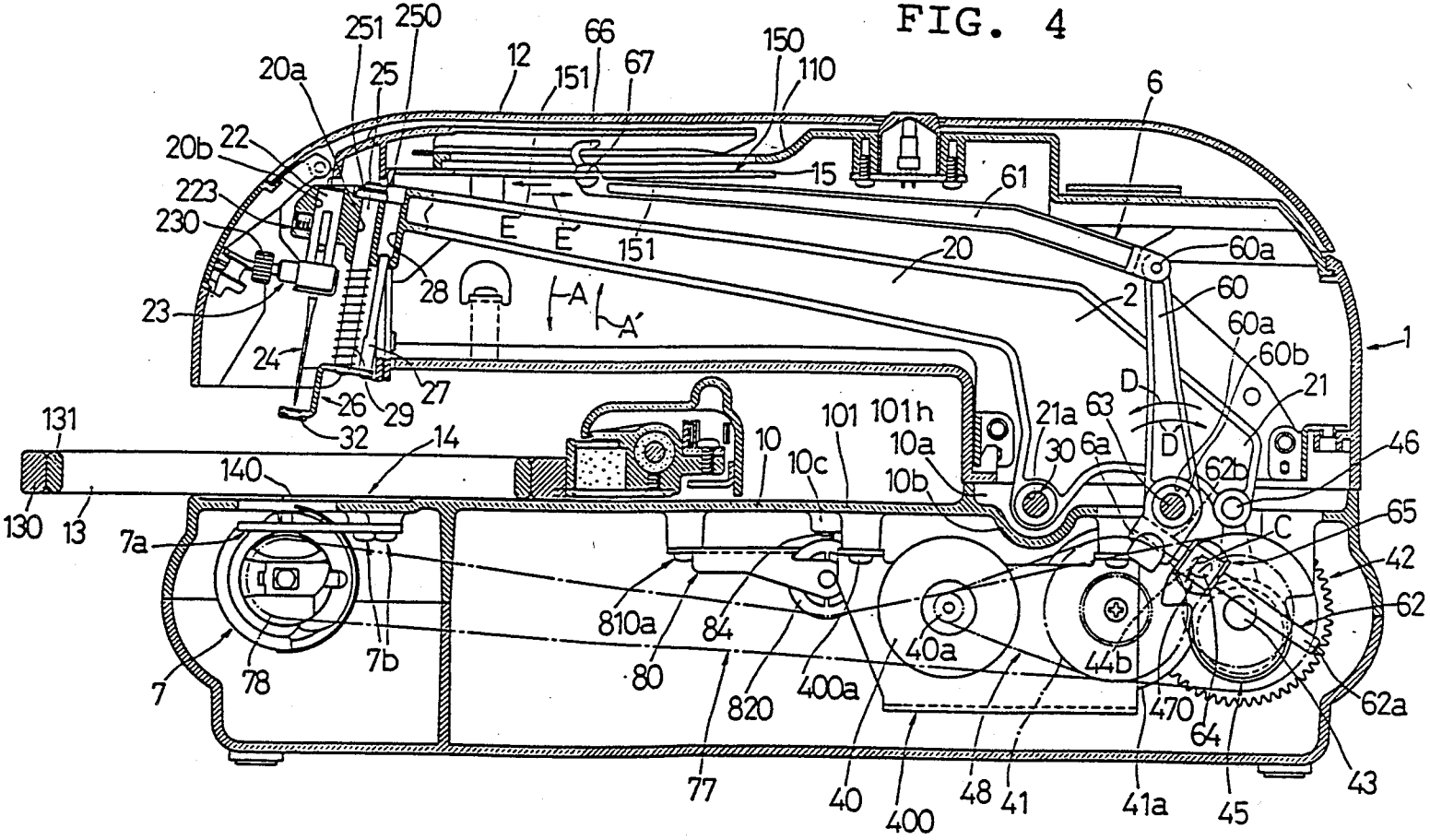
FIG. 4 is a cross sectional view taken along line IV—IV of FIG. 3.

A needle bar arm 2 will be hereinafter described with reference to FIGS. 2, 4 and 5. The needle bar arm 2 has a laterally-long arm 20 having reducing width toward its front end and extending laterally as well as obliquely, and a riser 21 integral with the laterally-long arm 20 and having a large width and a shorter height. A needle bar 22 is installed with a set screw 223 to a hole **20*b* at the front end of the needle bar arm 2. A needle stopper 23 is installed with a needle stopper set screw 230 to the bottom end of the needle bar 22. A needle 24 for stitching is installed to the needle stopper 23. The height of the riser 21 of the needle bar arm 2 is set by taking the heights of the needle bar 22 and the needle 24 into consideration, so that the needle 24 swinging around a swing shaft 30 is perpendicular or substantially perpendicular to the throat plate 14. A pressure bar 25 is ejectably inserted into a hole 20*a* of the laterally-long arm 20** of the needle bar arm 2. A retainer ring 250 and an O-ring 251 are installed to the upper end of the presser bar 25, so that the presser bar 25 do not come off. A metal presser body 26 for pressing a cloth is installed to the bottom end of the presser bar 25. As shown in FIG. 4, a guide bar 27 installed to the presser body 26 is inserted in a guide hole 28 of the needle bar arm 2. A spring 29 is installed between the presser body 26 and the needle bar arm 2. A resilient substance 32 is installed on the bottom surface of the presser body 32. The resilient substance 32 is made of a ring-shaped rubber, and improves the cushioning and cloth pressing functions.

A swing shaft 30 is inserted horizontally through a hole 21*a* formed at the lower portion of the riser 21 of the needle bar arm 2. As shown in FIG. 2, bearings 300, a spring 301 and retainer rings 302 are installed to the swing shaft 30. Turning to FIG. 4, the swing shaft 30 is disposed horizontally and rotatably supported by walls 10*a* adjacent concaved portions 10*b* formed in the bed 101 of the bed housing 10.

Turning back to FIG. 2, a drive unit for swinging the needle bar arm 2 includes a drive motor 40, a large diameter idle pulley 41 for reducing a speed of the drive motor 40, a small diameter pulley 40*a* (shown in FIG. 4) press-fitted into the motor shaft of the drive motor 40, a belt 48 installed to the idle pulley 41 and the pulley 40*a*, a large gear 42 engaging gear teeth 41*a* of the idle pulley 41, a main shaft 43 rotating integrally with the large gear 42, a thread take-up lever crank 44 fixed to the end of the main shaft 43 with a pin 440, and a needle bar crank rod 45 having a hole 45*a*. The drive unit is disposed in the bed housing 10 of the housing 1 as shown in FIG. 4. The drive motor 40 is held with a motor installing plate 400 fixed to bosses 101*h* with screws 400*a* as shown in FIG. 4. Turning now to FIG. 5, the hole 45*a* of the needle bar crank rod 45 engages a cam 44*a* of the thread take-up lever crank 44, and spherical bearings 43*a* are installed to the main shaft 43. Turning back to FIG. 3, the spherical bearings 43*a* are held with holders 10*h*, and the holders 10*h* holding the spherical bearings 43*a* are installed to the bosses 10*e* of the bed housing 10 with the screws 10*g*. The idle pulley 41 is supported with the support shaft 49, and the support shaft 49 is installed to the motor installing plate 400 with a retainer ring 49*a*.

Turning back again to FIG. 2, a needle bar drive shaft 46 is inserted into a hole 45*c* of a connecting rod 45*b* of the needle bar crank rod 45 and a hole 21*b* of the riser 21 of the needle bar arm 2, and held with retainer rings 46*a*. Turning to FIG. 5, as can be clearly seen from the drawing, the cam 44*a* of the thread take-up lever crank 44 is eccentric to the axis of the main shaft 43. Accordingly, the connecting rod 45*b* of the needle bar crank rod 45 reciprocates and swings in the vertical direction since the eccentric cam 44*a* turns as the main shaft 43 turns. Thus, the riser 21 of the needle bar arm 2 reciprocates in the vertical direction, and the needle bar arm 2 reciprocates and swings around the swing shaft 30 in the directions of the arrows A and A' as shown in FIG. 4.

Figure 2:
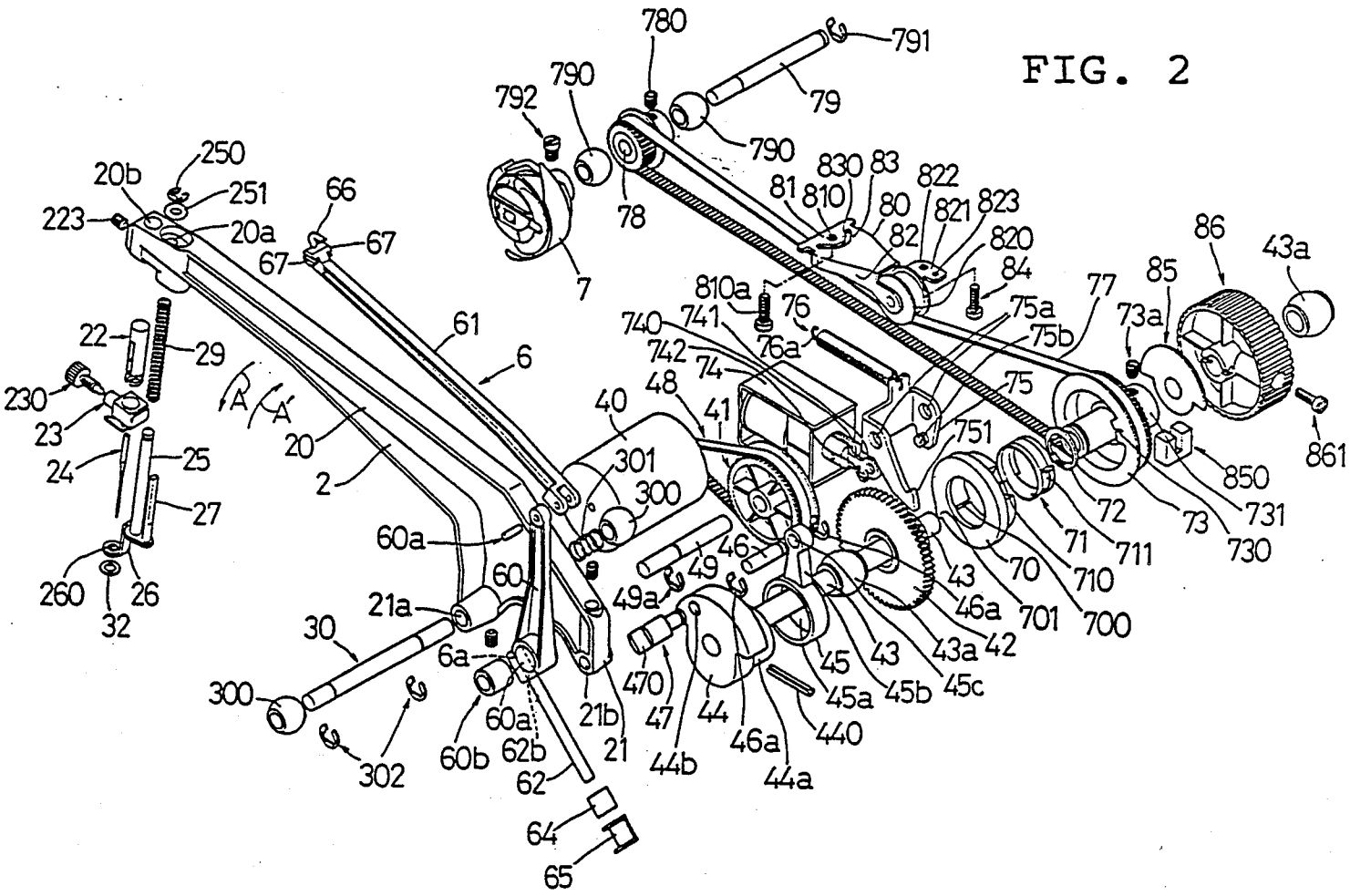
FIG. 2 is an exploded perspective view of major units of the sewing machine.

As illustrated in FIG. 2, a thread take-up lever 6 is disposed adjacent the needle bar arm 2. The thread take-up lever 6 loosens and tenses the upper thread, and has a rising arm 60 having a shorter height, and also has a laterally-long arm 61 rotatably held with a pin 60*a* to the rising arm 60. The thread take-up lever 6 is run by a slider-crank mechanism: a slide shaft 62 is installed to a hole 6*a* formed at the bottom end of the rising arm 60 of the thread take-up lever 6, and a bushing 64 made of a powder alloy and working as a slider is inserted on the slide shaft 62 slidably in the axial direction of the slide shaft 62, and the bushing 64 is held at its both ends by a bushing holder 65.

As shown in FIG. 4, a thread take-up lever shaft 63 is inserted into a thread take-up lever shaft hole 60*a* through a bearing 60*b*. The thread take-up lever shaft hole 60*a* is formed adjacent the hole 6*a* of the rising arm 60 of the thread take-up lever 6. Thus, the thread take-up lever 6 is held with the bed housing 10 so as to swing around the thread take-up lever shaft 63. Turning back to FIG. 2, a crank pin 47 having a U-shaped portion 470 at the end is rotatably inserted into a hole 44*b* of the thread take-up lever crank 44. Turning back again to FIG. 4, the U-shaped portion 470 holds the bushing 64.

Still referring to FIG. 4, a hook 66 is formed at the front end of the laterally-long arm 61 of the thread take-up lever 6, and two engaging grooves 67 are formed in the both sides of the hook 66. As can be seen from FIG. 4, a guide member 15 having a guide slot 150 is disposed horizontally and directly below an upper plate 110 of the arm housing 11. The periphery 151 forming the guide slot 150 engages the engaging grooves 67 of the hook 66. Thus the engaging grooves 67 of the hook 66 are guided substantially horizontally along the guide slot 150. Since the periphery 151 of the guide slot 150 is placed on the both sides of the hook 66, it is possible to prevent the hook 66 from falling down. The top end of the hook 66 protrudes upward from the upper plate 110 of the arm housing 11.

Figure 6:
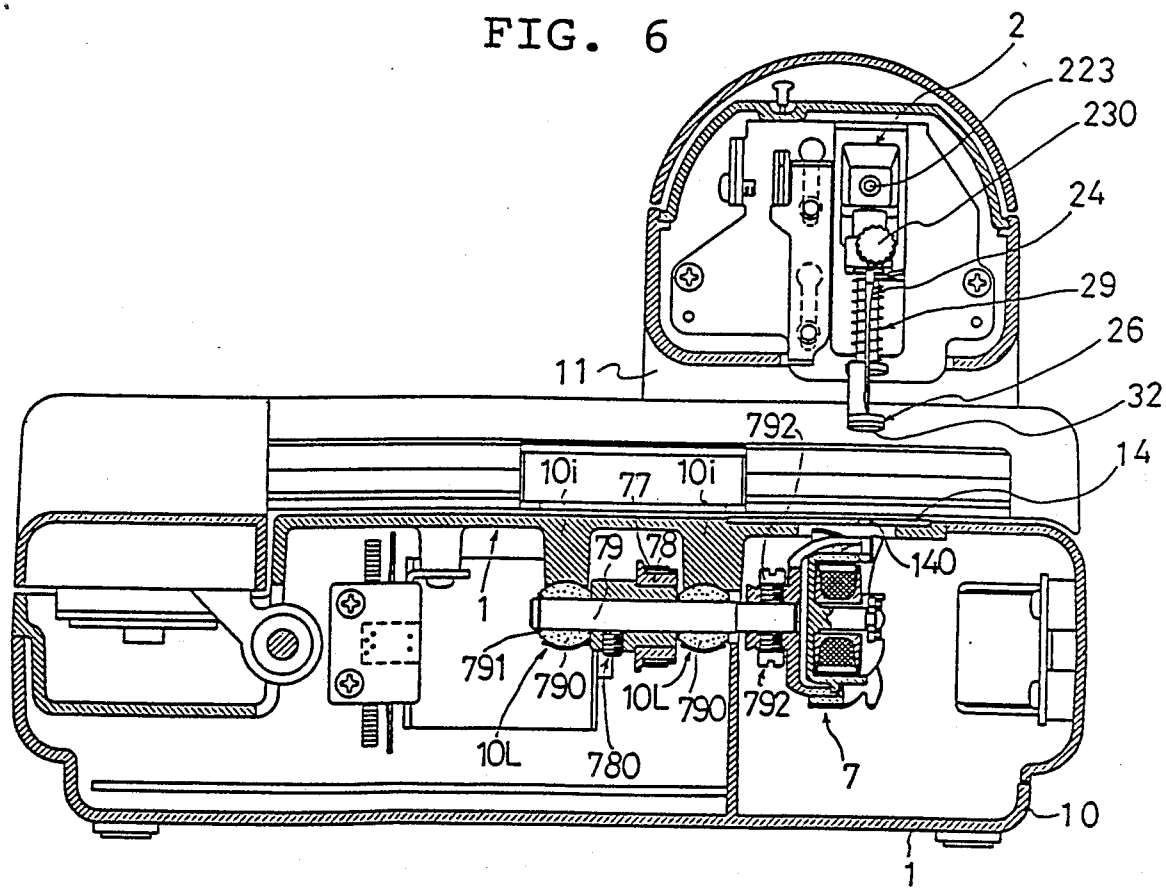
FIG. 6 is a cross sectional view taken along line VI—VI of FIG. 3.
Figure 7:
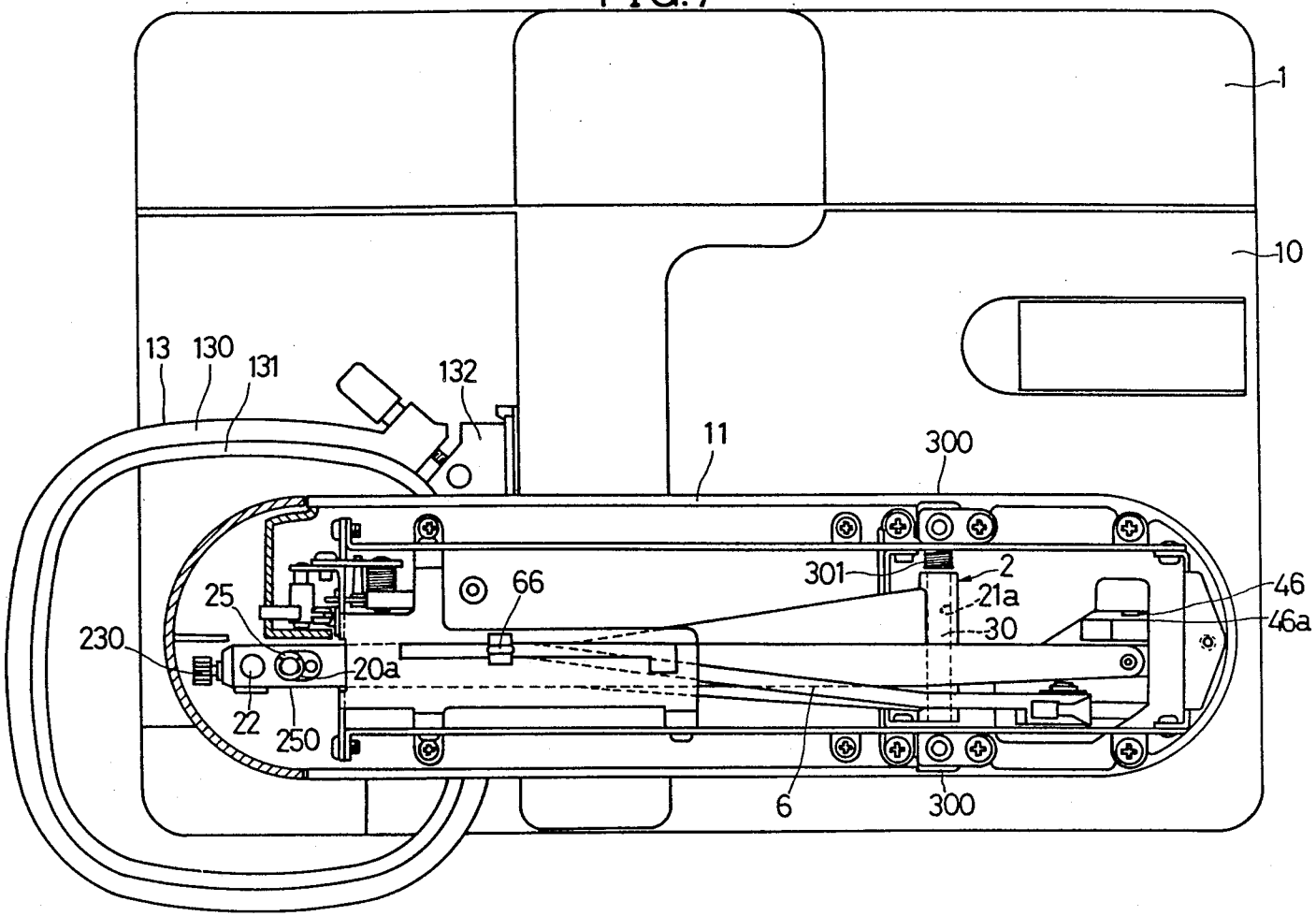
FIG. 7 is a plan view of the sewing machine with its top cover removed.

As illustrated in FIG. 4 and 6, a rotary hook 7 is disposed underneath the throat plate 14 in the bed housing 10 of the housing 1. The rotary hook 7 is fixed to a rotary hook shaft 79 with set screws 792. The rotary hook shaft 79 is inserted through spherical bearings 790, and disposed horizontally as well as parallel with the main shaft 43. In FIG. 4, a hook retainer is designated at 7*a*, and is fixed with screws 7*b* to the bed housing 10. Turning back to FIG. 3, the spherical bearings 790 are held with holders 10*L*, and the holders 10*L* holding the spherical bearings 790 are installed with screws 10*k* to bosses 10*i* formed on the bed housing 10.

Referring now to FIG. 6, a small timing gear 78 is installed to the rotary hook shaft 79 with a set screw 780. Turning now to FIGS. 2 and 5, a one-way clutch 71 including a clutch actuating ring 70 iand a leaf spring, a ring 72 and a large timing gear 73 are installed to the main shaft 43. The large timing gear 73 is joined to the main shaft 43 with a set screw 73*a* screwing in the timing gear shaft 731, and turns as the main shaft 43 turns. A slit 700 of the clutch actuating ring 70 engages an axial protrusion 710 of the one-way clutch 71. And a slit 730 of the large timing gear 73 engages a radial protrusion 711 of the olne-way clutch 71.

Figure 8:
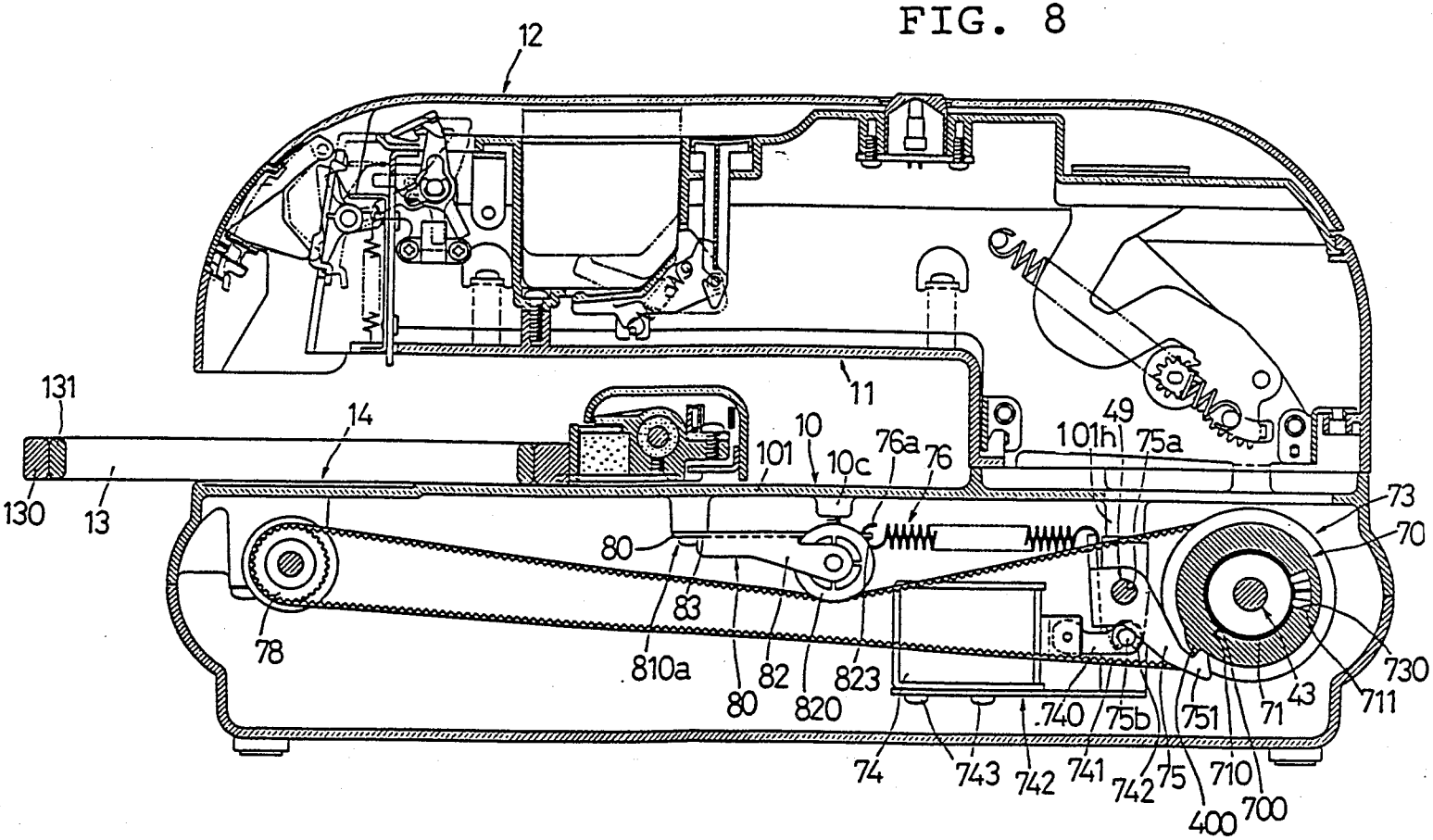
FIG. 8 is a cross sectional view taken along line VIII—VIII of FIG. 3.

As can be seen from FIGS. 2 and 8, a solenoid 74 and a clutch actuating pawl 75 are disposed adjacent the clutch actuating ring 70. A support shaft 49 is inserted through holes 75*a* of the clutch actuating pawl 75, and the clutch acuating pawl 75 swings around the holes 75*a*. A pin 75*b* of the clutch actuating pawl 75 is inserted to a hole 741 of a rod 740 of the solenoid 74, and is fixed with a retainer ring 742. The clutch actuating pawl 75 is urged with a spring 76. Though a pawl 751 of the clutch actuating pawl 75 tries to engage with a pawl 701 of the clutch actuating ring 70, the pawl 751 of the clutch actuating pawl 75 is disengaged from the pawl 701 of the clutch actuating ring 70 since the clutch actuating pawl 75 is attracted by the solenoid 74 by way of the rod 740. Accordingly, the one-way cltuch 71 is operated in the tightening direction, and the main shaft 43 and the large timing gear 73 are joined together witht he tightened one-way clutch 71. Thus, the large timing gear 73 turns as the large gear 42 turns the main shaft 43. Then, a toothed timing belt 77 turns the small timing gear 78, and the rotary hook shaft 79 and the rotray hook 7 turn.

In this preferred embodiment, the number of gear teeth of the large timing gear 73 is twice the number of gear teeth of the small timing gear 78. Thus, when the large timing gear 73 turns by one revolution, the small timing gear 78 turns by two revolutions. Namely, when the main shaft 43 turns by one revolution to reciprocate the needle bar arm 2 once, the rotary hook 7 turns by two revolutions. An end **76*a* of the spring 76 is hooked to a hook hole 823 of a bracket 80** as later described.

When stopping of the rotation of the rotary hook 7 is desired in order to finish embroidery, the control unit energizes the solenoid 74. The rod 740 advances, and the clutch actuating pawl 75 turns around the holes **75*a* to engage the pawl 751 with the pawl 701 of the clutch actuating ring 70. Accordingly, the one-way clutch 71 is operated in the untightening direction and the main shaft 43 and the large timing gear 73 do not turn, though the large gear 42 turns. Thus, the rotation of the rotary hook 7 stops, since the large timing gear 73 stops and the timing belt 77 does not turn. As illustrated in FIG. 8, the solenoid 74 is installed on the motor installing plate 400 with screws 743, and the motor installing plate 400 is installed with screws 400*a* (not shown) to bosses 101*h* formed on the bed housing 10**.

Referring now to FIGS. 2 and 8, a bracket 80 is disposed over the timing belt 77. The bracket 80 is made of a metal plte, and has a fastening portion 81 with a fastening hole 810, a pulley supporting portion 82 rotatably supporting a pulley 820, and deflecting portion 83 disposed between the fastening portion 81 and the pulley supporting portion 82. A slit 830 is formed in the deflecting portion 83 to make the deflection easy. The pulley supporting portion 82 is bent to a U-shape so that the shape offers a reinforcement rib effect and makes the bracket 80 strong enough. A protrusion 821 is formed in the pulley supporting portion 82, and a female threaded hole 822 is formed in the protrusion 821. As shown in FIG. 8, the bracket 80 is fixed on the bottom surface of the bed 101 of the bed housing 10 with a set screw **810*a* inserted through the fastening hole 810. Further, an adjusting male screw 84 is screwed in the female threaded hole 822 of the protrusion 821. The end of the adjusting male crew 84 contacts a contacting boss 10*c* formed on the bottom surface of the bed 101 of the bed housing 10. Accordingly, as the deflecting portion 83 deflects and the female threaded hole 822 engaging the adjusting male screw 84 is displaced in the vertical direction by turning the adjusting male screw 84. Thus, the positions of the pulley supporting portion 82 and the pulley 820 of the bracket 80 are adjusted in the vertical direction, and the tension of the timing belt 77 is adjusted. As a result, the loose timing belt 77 can be avoided, and the synchronism between the rotary hook 7 and the needle bar arm 2**; i.e. the synchronism between the upper thread and lower thread, can be secured effectively.

Figure 3:
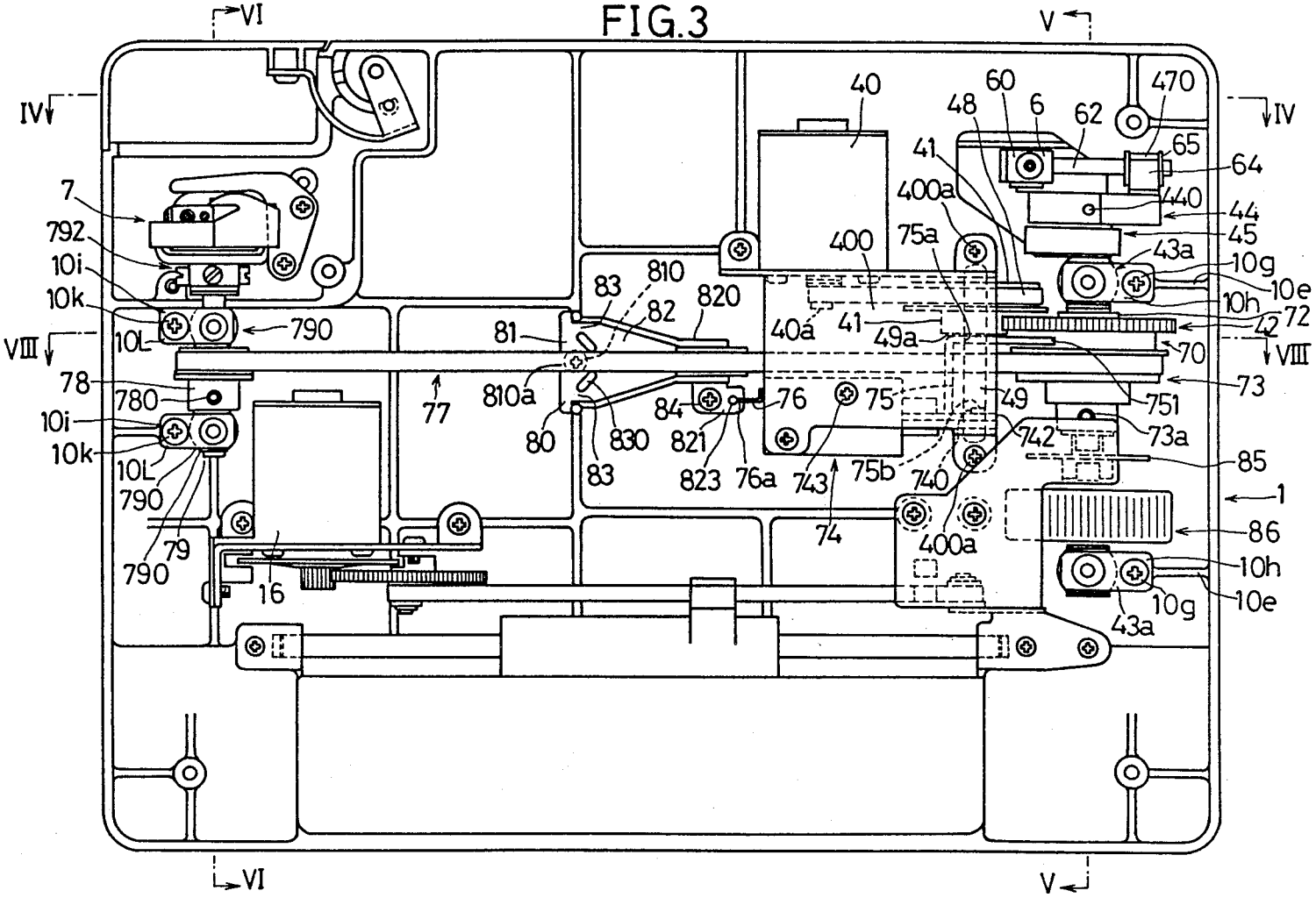
FIG. 3 is a bottom view of the sewing mahcine with its bed cover removed.
Figure 5:
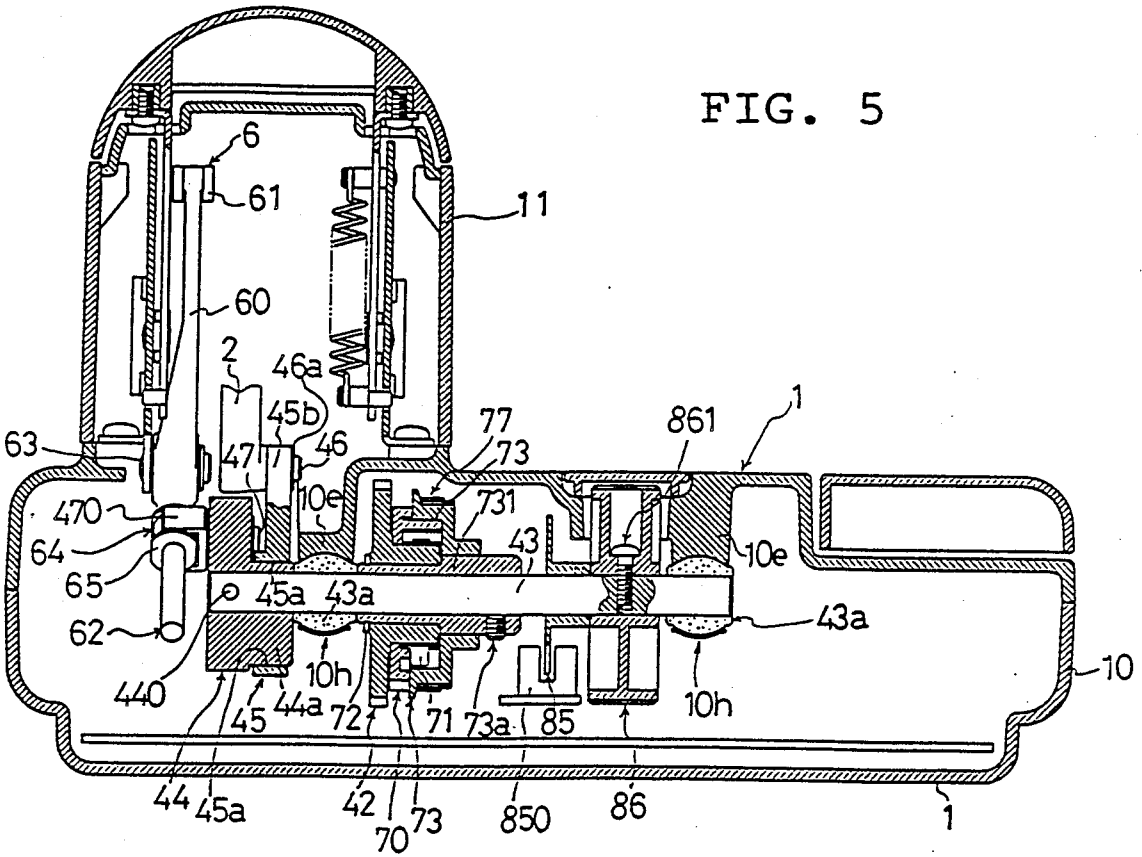
FIG. 5 is a cross sectional view taken along line V—V of FIG. 3.

As illustrated in FIG. 2 and 5, a detector plate 85 comprising two semi-circles; i.e. a semi-circle with a larger diameter and a semi-circle with a smaller diameter, is installed to the main shaft 43. And a hand wheel 86 for the manual operation is installed to the main shaft 43 with a set screw 86. The rotation of the detector plate; i.e. the rotation of the main shaft 43, is detected with a photo-interrupter 850. The photo-interrupter 850 is built-in in the bed housing 10, and works as a visual sensor. When embroidery is disturbed by entangled threads, first the drive motor 40 is stopped, and then the hand wheel 86 is manually operated to turn the main shaft 43 in order to adjust positions of the needle bar arm 2, the rotary hook 7, and the thread take-up lever 6. Further, as shown in FIG. 3, a spherical bearing **43*a* is installed to one end of the main shaft 43, and held with a holder 10*h*, and the holder 10*h* is installed to a boss 10*e* of the bed housing 10 with a screw 10*g***.

Operation of the Sewing Machine

The operation of the sewing machine according to the present invention will be hereinafter described.

A cloth is set to the embroidery frame 13. Then, an upper thread is run through the needle 24 and hooked at the hook 66 of the thread take-up lever 6. A power switch is turned onto run the drive motor 40. The rotation of the drive motor 40 is transmitted to the belt 48, the idle pulley 41 and the large gear 42, and the main shaft 43 is rotated in the counterclockwise direction in FIG. 2. And then, the connecting rod **45*b* of the needle bar crank rod 45 swings in the vertical direction since the needle bar crank rod 45 is engaged with the cam 44*a* of the thread take-up lever crank 44 eccentric to the main shaft 43 and is turned as the cam 44*a* turns. Thus, the riser 21 of the needle bar arm 2, joined to the connecting rod 45*b* with the needle bar arm drive shaft 46, is moved in the vertical direction. As a result, the needle bar arm 2 reciprocates and swings around the swing shaft 30 in the directions shown by the arrows A and A' in FIGS. 2 and 4, and the needle 24 goes in and comes out the needle penetrating hole 140 of the throat plate 14**.

Figure 9:
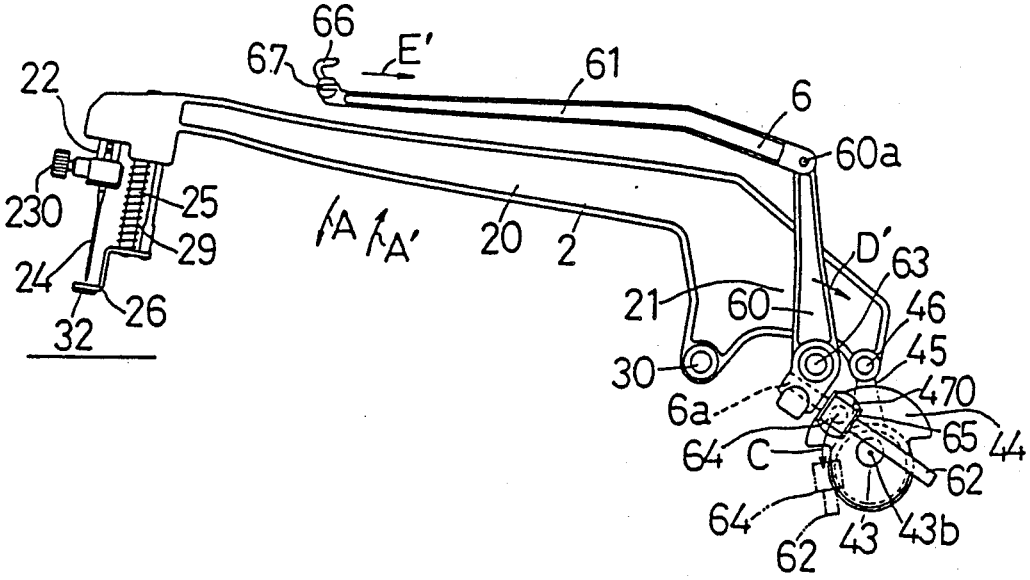
FIG. 9 is a side view illustrating a needle bar arm top dead center.
Figure 10:
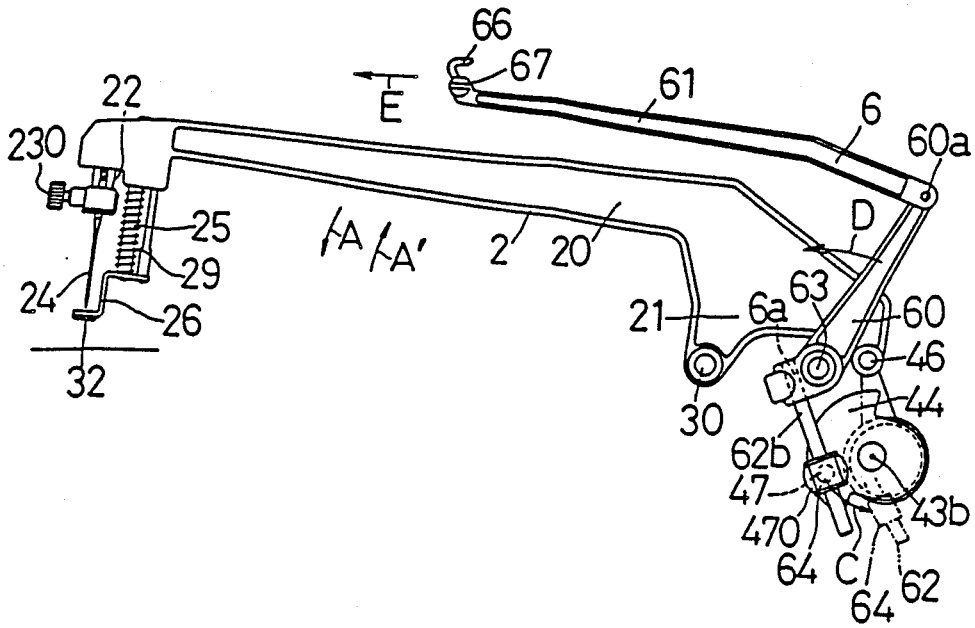
FIG. 10 is a side view illustrating a thread take-up lever top dead center.
Figure 11:
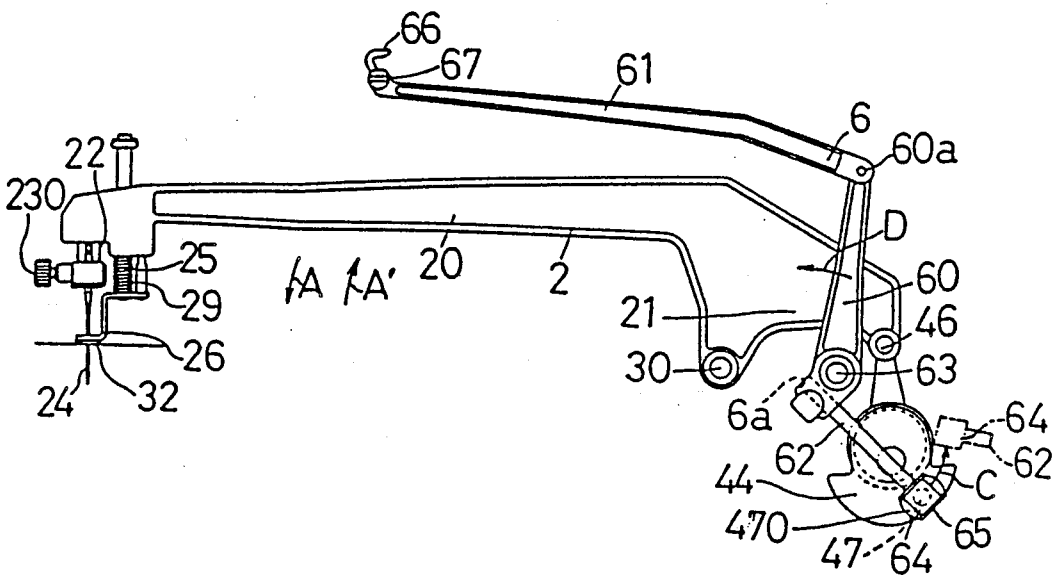
FIG. 11 is a side view illustrating a needle bar arm bottom dead center.

In this preferred embodiment, when the needle 24, swinging in the direction of the arrow "A", is adjacent the throat plate 14, the needle 24 gets perpendicular or substantially perpendicular to the throat plate 14 due to the following arrangements: the laterally-long arm 20 of the needle bar arm 2 is set laterally long, and the swing shaft 30 is disposed away from the needle 24, and the needle 24 swings with a large radius of curvature, and the axis of the swing shaft 30 and the top surface of the throat plate 4 are substantially flush with each other, or disposed at substantially same height. Thus, the needle 24 penetrates the cloth and the needle penetrating hole 140 in the perpendicular or substantially perpendicular manner. FIG. 9 shows that the needle bar arm 2 has fully ascended and is at the needle bar top dead center. FIG. 11 shows that the needle bar arm 2 has fully descended and is at the needle bar arm bottom dead center. As the main shaft 43 turns, the needle bar arm 2 swings in the order of FIGS. 9, 10, 11 and 12.

In this preferred embodiment, the rotation of the main shaft 43 is transmitted to run the one-way clutch 71, the large timing gear 73, the timing belt 77, the small timing gear 78 and the rotary hook shaft 79. As the rotary hook shaft 79 turns, the rotary hook 7 turns synchronously with the swing of the needle bar arm 2. Namely, when the needle bar arm 2 reciprocates one, the rotary hook 7 runs by two revolutions. When the needle 24 penetrates the cloth held in the embroidery frame 13 disposed over the throat plate 14 and goes in the needle penetrating hole 140, the lower thread fed out of the rotary hook 7 is hooked to the upper thread running through the needle 24, and stitches are produced with the upper and lower threads on the cloth. While this is happening, the embroidery frame 13 is moved with the X-axis and Y-axis motors controlled by the control unit, and embroidery is produced on the cloth.

The operation of the thread take-up lever 6 will be hereinafter described. Referring now to FIG. 4, the main shaft 43 turns in the counterclockwise direction, and the bushing 64 turns in the counterclockwise direction; i.e. the direction shown by the arrow "C" around the axis of the main shaft 43 since the bushing 64 is held with the U-shaped portion 470 of the crank pin 47 of the thread take-up lever crank 44. When this happens, the U-shaped portion 470 and the bushing 64 switch their directions of movements since the crank pin 47 turns with respect to the hole 44*b* of the thread take-up lever crank 44. Namely, the bushing 64 held with the U-shaped portion 470 slides over the slide shaft 62, and reciprocates repeatedly in the longitudinal direction of the slide shaft 62. Since the base end 62*b* (shown in FIG. 2) of the slide shaft 62 is held with the hole 6*a*, the slide shaft 62 varies its inclination angle as shown in FIGS. 9 through 12 as the bushing 64 turns in the direction of the arrow "C". The rising arm 60 of the thread take-up lever 6 to which the slide shaft 62 is fixed reciprocates the swings in the directions of the arrows "D" and "D'". On the other hand, the laterally-long arm 61 of the thread take-up lever 6 reciprocates in a substantially horizontal direction; i.e. in the directions of the arrows "E" and "E'" in FIG. 4, since the engaging grooves 67 of the hook 65 are guided by the guide slot 150 of the guide member 15, and reciprocate in substantially the horizontal direction.

Referring now to FIG. 9, when the needle bar arm 2 is at its top dead center, the bushing 64 is at the position shown with the solid lines in FIG. 9. Since the inclination angle of the slide shaft 62 is restricted by the bushing 64 and the hole 6*a*, the slide shaft 62 moves up, as shown with the alternate-long-and-two-short-dashes lines in FIG. 9, as the bushing 64 turns around the axis 43*b* of the main shaft 43 in the direction of the arrow "C". Thus, the rising arm 60 starts swinging in the direction of the arrow "D'" in FIG. 9. Accordingly, the hook 66 of the thread take-up lever 6 moves in the direction of the arrow "E'"; i.e. in the retracting direction, and approaches the top dead center. FIG. 10 shows that the thread take-up lever 6 has fully retracted, and is at its top dead center.

When the thread take-up lever crank 44 turns further and the bushing 64 turns further in the direction of the arrow "C" in FIG. 10, the slide shaft 62 inclines a little toward its lying position as shown with the alternate-long-and-two-short-dashes-lines in FIG. 10. Thus, the rising arm 60 of the thread take-up lever 6 starts swinging in the direction of the arrow "D", and the hook 66 moves in the direction of the arrow "E" in FIG. 10. As a result, the tension of the upper thread hooked at the hook 66 gets loose.

FIG. 10 illustrates that the needle 24 is in a state immediately before penetrating the cloth. It is necessary to loosen the tension of the upper thread in order to avoid the upper being torn off by excessive tension immediately before the needle 24 penetrates the cloth. Therefore, the tension of the upper thread hooked at the 66 is loosened by running the hook 66 in the direction of the arrow "E" as described above.

Figure 12:
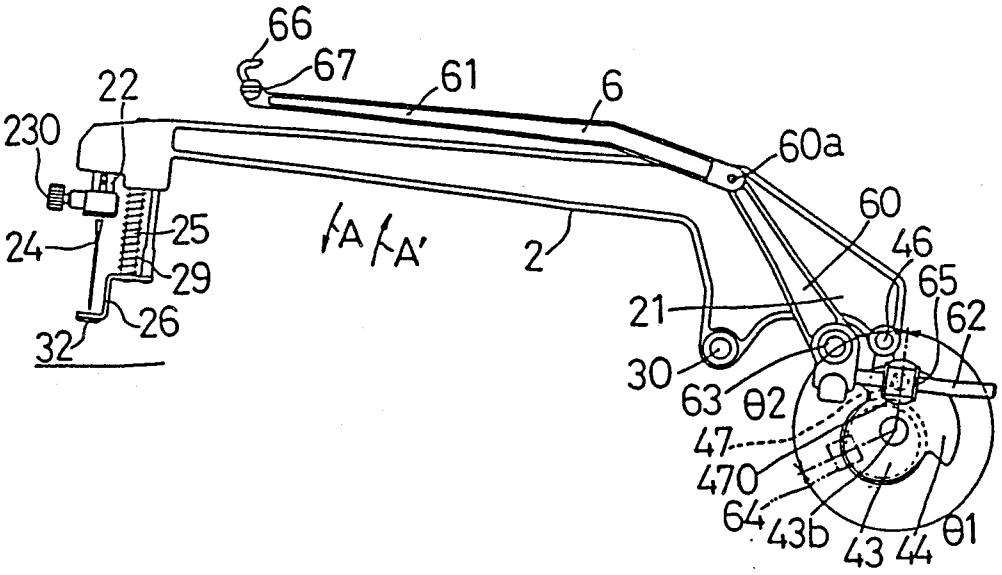
FIG. 12 is a side view illustrating a thread take-up lever bottom dead center.

FIG. 11 illustrates that the bushing 64 shown in the solid lines turns further in the direction of the arrow "C". In FIG. 11, the hook 66 runs further toward the needle 24 than is illustrated in FIG. 10, and the upper thread is further loosened. The slide shaft 62 approaches the substantially horizontally lying position as shown with the alternate-long-and-two-short-dashes lines in FIG. 11 from the position shown with the solid lines in FIG. 10, as the thread take-up lever crank 44 and the bushing 64 further turn in the direction of the arrow "C" in FIG. 11. Thus, the rising arm 60 of the thread take-up lever 6 further swings in the direction of the arrow "D" in FIG. 11, and the hook 66 of the thread take-up lever 6 further runs toward the needle 24 and approaches the thread take-up lever bottom dead center. FIG. 12 illustrates that the thread take-up lever 6 has advanced fully and is at the thread take-up lever bottom dead center.

In addition, the thread take-up lever employs a quick return mechanism. While the hook 66 is advancing toward the needle 24; i.e., while the thread take-up lever 6 is running from the thread take-up lever top dead center illustrated with the solid lines in FIG. 10 to the thread take-up lever bottom dead center illustrated with the solid lines in FIG. 12 by way of the intermediate states illustrated with the solid and the alternate-long-and-two-short-dashes lines in FIG. 11, the bushing 64 turns around the main shaft 43 by an angle of $\theta 1$ (See FIG. 12). On the other hand, while the hook 66 is retracting toward the swing shaft 30; i.e., while the thread take-up lever 6 is running from the thread take-up lever bottom dead center illustrated with the solid lines in FIG. 12 to the thread take-up lever top dead center illustrated witht he solid lines in FIG. 10, the bushing 64 turns around the main shaft 43 only by an angle of $\theta 2$ (See FIG. 12.). Thus, the hook 66 retracts quickly in a shorter period of time than it advances, since $\theta 1$ is larger than $\theta 2$ as shown in FIG. 12.

Advantage of the Sewing Machine

The sewing machine of the preferred embodiment described above employs the swing bar arm 2 swinging around the swing shaft 30 with respect to the bed housing 10. Thus, the overall height of the sewing machine has been reduced compared with the conventional sewing machine employing the longitudinally-long needle bar reciprocating in the vertical direction.

Especially, since the length of the laterally-long arm 20 of the needle bar arm 2 is long, the distance between the swing shaft 30; i.e. the swing center, and the needle 24 can be set larger. As a result, the radius of curvature of the needle 24 swinging in the needle penetrating hole 140 can be set larger, and the needle 24 effectively penetrates the needle penetrating hole 140 in the perpendicular manner.

As described above, the needle bar arm 2 swings around the swing shaft 30 in the sewing machine of the preferred embodiment. Thus, the needle bar 22 can be made shorter than that of the conventional sewing machine in which the longitudinally-long needle bar reciprocates in the vertical direction. Consequently, the inertial mass of the needle bar 22 is made less, and it is advantageous to reduce the vibration and noise of the sewing machine when the swing bar arm 2 swings at a high speed. Therefore, the arrangement of the sewing machine is advantageous to operate the sewing machine at a high speed. And since the sewing machine of the preferred embodiment does not require a complex link mechanism for holding the needle bar 22, since the needle bar 22 is simply fixed to the swinging needle bar arm 2, it distinguishes over the sewing machine of Japanese Examined Patent Publication (KOKOKU) No. 30179/1969 employing the complex link mechanism.

The arrangement of the preferred embodiment reduces the height of the bed housing 10 and eventually the overall height of the housing 1 effectively, since the sewing machine of the preferred embodiment further distinguishes over the Examined Patent Publication (KOKOKU) No. 30179/1969 with the following features: The bed housing 10 having a reduced height accomodates the driving unit including the swing shaft 30, the main shaft 43, the driving motor 40, the idle pulley 41, the large gear 42, the thread take-up lever shaft 63, the needle bar crank rod 45, the thread take-up lever crank 44 and the rotary shaft 79. And the main shaft 43, the swing shaft 30 and the rotary hook shaft 79 lie in the horizontal direction, and disposed in parallel with each other.

Since the drive unit including the swing shaft 30, the main shaft 43, the driving motor 40, the idle pulley 41 and the large gear 42 and so on are disposed in the bed 101 of the bed housing 10 as described above, it is not necessary to produce the arm housing 11 with a high strength and a strict dimensional accuracy as required for producing the bed 101 of the bed housing 10. Thus, the arm housing 11 may be made of a synthetic resin. It is advantageous to reduce the weight and cost of the sewing machine, since no conventional material, such as cast iron having a heavier weight and die case aluminum associating with a higher cost, may be employed for producing the arm housing 11.

What is claimed is:

1. A sewing machine comprising:

a bed housing having a needle penetrating hole at one end thereof;

an arm housing rising from the other end of said bed housing and extending to said one end of said bed housing over said bed housing;

a needle bar arm rotatably held in said arm housing and having a needle at a front end thereof;

a swing shaft in said bed housing for rotatably holding said needle bar arm disposed in a substantially horizonal direction, an axis of said swing shaft being disposed at a height substantially identical with a height of a top surface of a throat plate having a needle penetrating hole and held on said bed housing; and a drive unit for swinging said needle bar arm with respect to the bed housing, said drive unit being accommodated in said bed housing.

2. A sewing machine comprising:

a bed housing having a needle penetrating hole at one end thereof;

an arm housing rising from the other end of said bed housing and extending to said one end of said bed housing over said bed housing;

a needle bar arm having a needle at a front end thereof, rotated with a drive shaft and rotatably held with a swing shaft in said arm housing;

an upper thread taking up means disposed adjacent said needle bar arm;

a lower thread feeding means for feeding a lower thread;

a drive unit for running said needle bar arm, said upper thread taking up means and said lower thread feeding means; and a transmission means for transmitting the movement of said drive unit to said lower thread feeding means, wherein said thread taking up means comprises a rising arm run by said drive unit, and a laterally-long arm rotatably held to said rising arm, moving substantially horizontally and having a hook at the front end thereof.

3. A sewing machine according to claim 2, wherein said needle bar arm comprises a riser held rotatably to said swing shaft, and a laterally-long arm having a laterally long length and integral with said riser.

4. A sewing machine comprising:

a bed housing having a needle penetrating hole at one end thereof;

an arm housing rising from the other end of said bed housing and extending to said one end of said bed housing over said bed housing;

a needle bar rotatably held in said arm housing having a needle at a front end thereof;

a swing shaft disposed in a substantially horizontal direction, and rotatably holding said needle bar arm, the axis of said swing shaft being flush with the top surface of said bed housing;

an upper thread taking up means disposed adjacent said needle bar arm;

a lower thread feeding means for feeding a lower thread;

a drive unit for running said needle bar arm, said upper thread taken up means and said lower thread feeding means; and a transmission means for transmitting the movement of said drive unit to said lower thread feeding means.

5. A sewing machine according to claim 4, wherein said drive unit includes a drive motor held in said bed housing, a main shaft held in a substantially horizontal direction as well as in a substantially parallel manner with said swing shaft held in said bed housing and run by said drive motor, and a converter for converting the rotation of said main shaft into the swing of said needle bar arm and said upper thread taking up means held in said bed housing and disposed between said needle bar arm and said main shaft.

6. A sewing machine according to claim 4, wherein said lower thread feeding means includes a rotary hook shaft disposed in a substantially parallel manner with said main shaft, and a rotary hook rotated by said rotary hook shaft.

7. A sewing machine comprising:

a bed housing having a needle penetrating hole at one end thereof;

an arm housing rising from the other end of said bed housing and extending to said one end of said bed housing over said bed housing;

a needle bar arm rotatably held in said arm housing and having a needle at a front end thereof;

a drive unit for swinging said needle bar arm with respect to the bed housing, said drive unit being accommodated in said bed housing, wherein said needle bar arm is rotatably held with a swing shaft held in a substantially horizontal direction in said bed housing, and wherein said drive unit includes a drive motor held in said bed housing, a main shaft held in a substantially horizontal direction as well as in a substantially parallel manner with said swing shaft, said swing shaft being held in said bed housing and rotated by said drive motor, and a converter for converting a rotation of said main shaft into the swing of said needle bar arm held in said bed housing and disposed between said needle bar arm and said main shaft.

8. A sewing machine according to claim 6, wherein said bed housing has a rotary hook shaft held in a substantially horizontal direction as well as in a substantially parallel manner with said main shaft, a rotary hook run by said rotary hook shaft, and a transmission unit for transmitting the rotation of said main shaft to said rotary hook shaft disposed between said rotary hook shaft and said main shaft; and said transmission unit includes a first timing gear on said main shaft, a second timing gear on said rotary hook shaft, and a timing belt on said first and second timing gears.

* * * * *

UNITED STATES PATENT AND TRADEMARK OFFICE

CERTIFICATE OF CORRECTION

PATENT NO. : 4,875,422

DATED : OCTOBER 24, 1989

INVENTOR(S) : HITOSHI ISHIKAWA

It is certified that error appears in the above-identified patent and that said Letters Patent is hereby corrected as shown below:

Column 3, line 2, change "anhd" to --and--;

Column 4, line 39, change "10" to --100--;

Column 13, line 1, change "6" to --7--.

Signed and Sealed this

Fourth Day of June, 1991

*Attest:*

HARRY F. MANBECK, JR.

*Attesting Officer*

*Commissioner of Patents and Trademarks*